United States Patent [19]

Boer et al.

[11] 4,419,719

[45] Dec. 6, 1983

[54] LUMINAIRE

[75] Inventors: Kornelis Boer; Hugo De Widt, both of Oss, Netherlands

[73] Assignee: U.S. Philips Corporation, New York, N.Y.

[21] Appl. No.: 264,264

[22] Filed: May 18, 1981

[30] Foreign Application Priority Data

Jun. 13, 1980 [NL] Netherlands ..... 8003434

[51] Int. Cl.[3] ..... F21S 2/00

[52] U.S. Cl. ..... 362/218; 362/221; 362/294

[58] Field of Search ..... 362/218, 294, 221

[56] References Cited

U.S. PATENT DOCUMENTS

| | | | |
|---|---|---|---|
| 3,974,418 | 8/1976 | Fridrich | 362/218 |
| 4,044,246 | 8/1977 | Docimo et al. | 362/294 |
| 4,104,713 | 8/1978 | Chan et al. | 362/294 |
| 4,302,798 | 11/1981 | Sit | 362/294 |

*Primary Examiner*—Stephen J. Lechert, Jr.

*Attorney, Agent, or Firm*—Norman N. Spain

[57] ABSTRACT

Luminaire for a tubular discharge lamp, having an elongate housing (1) the ends of which comprise means (4, 5) for accommodating the lamp, at least an electric ballast (6) being present in the housing (1), which housing is filled with cured foamed plastics material (11), the housing (1) being a through with a generally U-shaped cross-section and the foam (11) extending to the open side of the housing.

8 Claims, 5 Drawing Figures

LUMINAIRE

Figure 1:
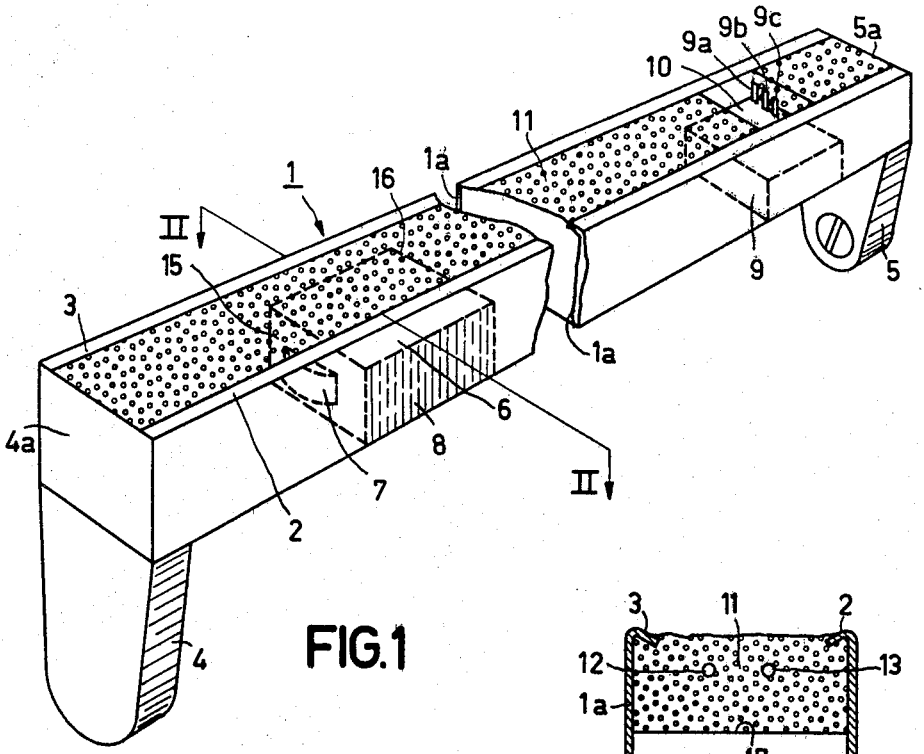

The invention relates to a luminaire for at least one tubular discharge lamp, provided with an elongate thin walled housing with external means at its ends for accommodating the lamp(s), at least one electric stabilization ballast being present in the housing, the housing being filled with cured foamed plastics material. Such a luminaire is disclosed in German Offenlegungsschrift No. 1,914,094.

The above-described luminaire is used as a carrier of tubular low-pressure mercury vapour discharge lamps such as fluorescent lamps. Such a luminaire, filled with a quantity of cured foamed plastics material, and having thin walls, for example of sheet metal, is very easy to handle because of its relatively low weight. The electric components required for operation of the lamp, such as the ballast and the electric connecting wires required for the lamp and for these components, are accommodated in the housing of the luminaire and are surrounded by the said foamed plastics material. Such a luminaire can safely be touched by hand, and unwanted sound vibrations caused by the ballast are suppressed. In addition, the use of foamed plastics material makes the use of comparatively thin walls for the housing possible, which results in a saving of material.

The housing of the prior art luminaire comprises four walls which extend in the longitudinal direction such that the housing has a substantially rectangular cross-section. The ends of the housing are provided with fittings for one or more lamps.

During the manufacture of the known luminaire, the foamed plastics material is preferably injected as liquid compound into the housing via an aperture in one of the walls, and cured there at an excess pressure to form a foamed solid material. During this procedure the ballast (consisting of, for example, a number of turns of insulated copper wire around a laminated iron core) is pressed against a wall of the housing, thus forming between that wall and the ballast a suitable path for discharge of the heat generated by the ballast during operation of the lamp.

A disadvantage of the known luminaire is that during manufacture a wall of the housing must be provided with a special aperture through which the said liquid compound can be injected. The liquid compound has to travel a relatively long way inside the housing in order to completely fill the space within the housing. This is a complicated procedure, which imposes special requirements on the foam. In addition, it is rather difficult to position the electric and mechanical components (such as the ballst) which are necessary for operation of the lamp in a luminaire of the shape described in the above-mentioned OffenlegungsSchrift.

It is an object of the invention to provide a luminaire which has a relatively low weight, is easy to handle and can be manufactured in a simple way.

To accomplish this object the invention relates to a luminaire or the type described in the preamble, which is characterized in that the housing is a trough which a generally U-shaped cross-section and the cured foamed plastics material extends to the open side of the housing.

A luminaire in accordance with the invention can be manufactured in a relatively simple way. Since the housing of such a luminaire has a profile which is open at one side along the full length of the housing, it is easy to position the electrical and mechanical components (such as the ballast and the glow-discharge starter) in the housing during manufacture. In addition, the presence of the open side provides the advantage that the required foam can be quickly applied over the full length of the housing, for example in the form of a liquid compound, by means of an injector which is moved along the housing. The foam which is formed from the liquid then only needs to travel a short distance in the housing. This allows an accurate dosing of the locally required quantity of foam. No special apertures in the wall are necessary in a luminaire in accordance with the invention. The housing of a luminaire of the invention is preferably of such a shape and is so dimensioned that the ballast bears against three sides of the housing. In this way a most advantageous discharge of the heat generated in the ballast is obtained during operation of the ballast. The ballast which is usually prism-shaped is positioned by means of the cured foam in the housing at its end faces, and also at the side facing the open side of the housing. The cured, rigid foam between the ballast and an imaginary plane on the open side of the housing not only also functions as a heat insulator but also as an electrical insulator for the ballast. Any electric current supply wires (for example the mains supply wires) which are located in the region of the ballast but outside the housing, are protected by the said foam from the heat generated by the ballast. The outer surface of the ballast, consisting for example, of a number of thin lamellae, may be somewhat irregular, owing to small differences in the relative positions of the lamellae. As result thereof, some foam may be present locally between the ballast and a wall of the housing. However, the ballast and housing are dimensioned so that there still is sufficient contact between the two surfaces to ensure a proper heat discharge during operation.

The cured foamed plastics material in a luminaire according to the invention must satisfy a number of requirements which are particularly imposed on luminaires. The foam to be used must not only be easily workable in the liquid state, but must also be sufficiently heat-resistant after foaming and curing in view of the comparatively high temperatures to which the electric components in the foam may be heated during operation. Furthermore, the foam must be flame-retardant and must function as a good heat and electrical insulator. In addition, the foam must have good properties of adhesion to the thin walls (which consist of, for example, thin sheet metal). The housing in combination with the cured foam adhering to its wall has a high degree of rigidity. It has been found that relatively hard, inflexible foamed plastics material having a uniform structure of predominantly closed cells, such as poly-isocyanurate foam satisfies these requirements.

In a preferred embodiment of a luminaire according to the invention the wall edges of the housing at the open side are folded inwards. This structure feature still further increases the rigidity of the housing. The cured foam is then locked in the housing by the vertical edges.

In another embodiment of a luminaire according to the invention a recess is present in the surface of the cured foamed plastics material in the region of the open side of the housing, which recess extends in the longitudinal direction of the housing and accommodates, for example, electric supply wires in a conduit.

The luminaire may be fastened by various means to a wall or a ceiling, for example by means of a screwed connection. In a special embodiment of a luminaire according to the invention the luminaire comprises means for fastening the housing to a detectable elongate support which is positioned on the open side of the housing. For this purpose, the housing of the luminaire is provided with, for example, a sleeve containing a plunger which can be moved in the sleeve and which co-operates with gripping means projecting from the support. Such a coupling for connecting two members is disclosed in United Kingdom Pat. No. 1,560,521, The support, consisting for example of a plate which extends over at least a portion of the length of the housing and which has a width which approximately corresponds to the spacing between the vertical sides of the through is first fastened to a surface (for example a ceiling), whereafter the housing is fastened to the support by means of the above-described coupling.

A cavity is preferably provided in the foamed plastics material at the open side, current connecting pins being provided within the cavity. These pins co-operate with a socket which has been provided at that end of the plate-shaped support which faces the housing. The socket, which may form, for example, part of a terminal block, may be incorporated in said cavity.

The invention will now be further explained with reference to the accompanying drawings, which show embodiments of a luminaire of the invention.

Figure 2:
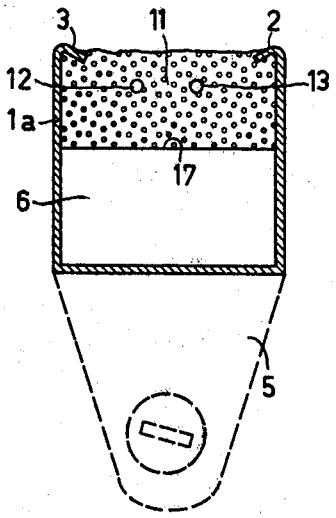
Figure 3:
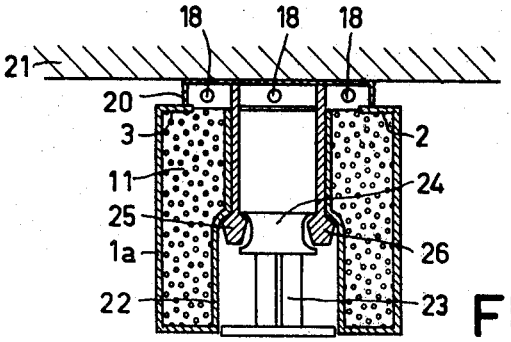
Figure 4:
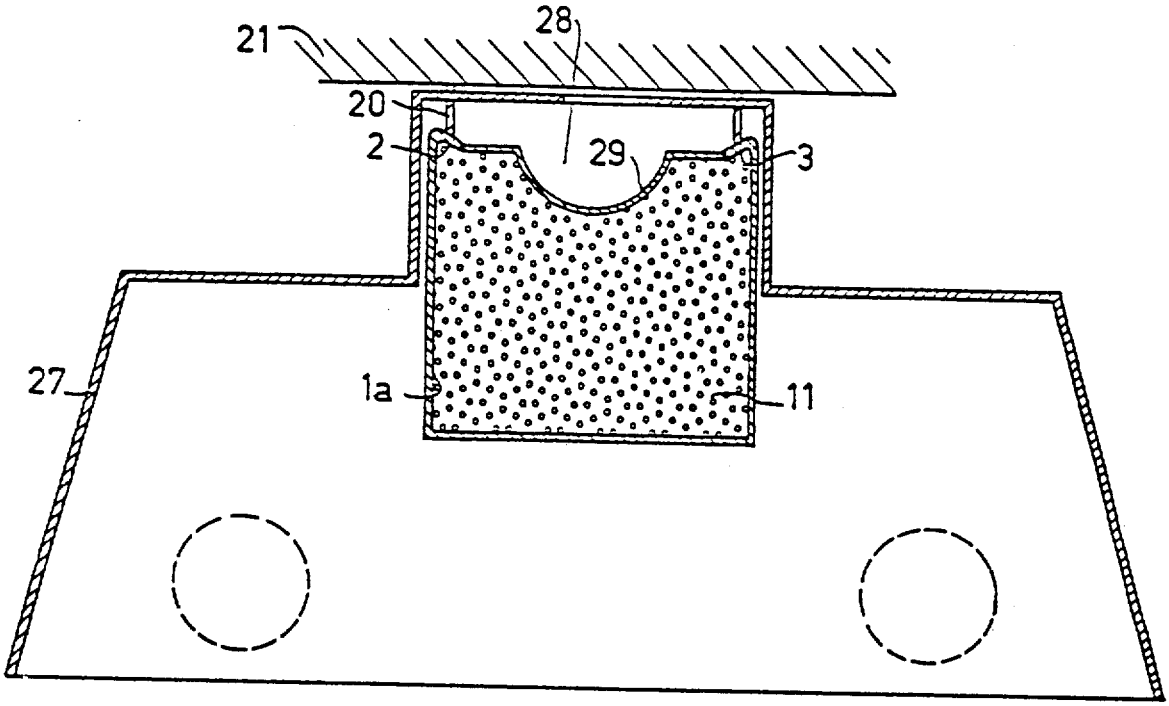
Figure 5:
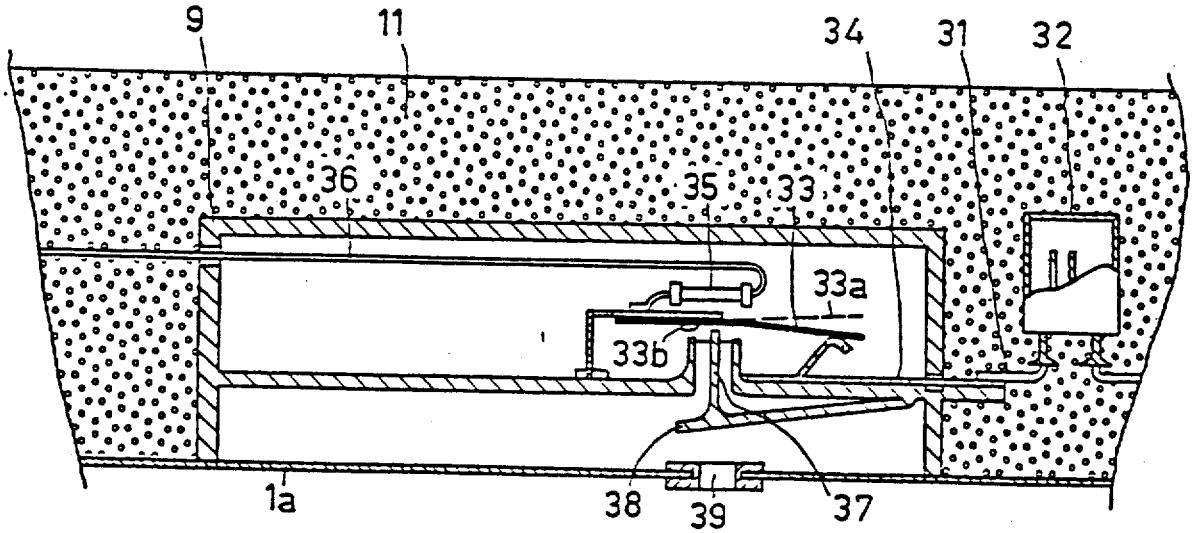

In the drawings:

FIG. 1 is a perspective view of a luminaire according to the invention,

FIG. 2 is a cross-sectional view of the luminaire of FIG. 1 taken on the line II—II, FIG. 3 is a cross-sectional view of a coupling suitable for connecting the luminaire of FIG. 1 and an elongate support, FIG. 4 is a cross-sectional view of a special embodiment of the luminaire according to the invention, and FIG. 5 is a longitudinal sectional view of a detail of a safety switch for a starter in the luminaire of FIG. 1, this starter being arranged in series with the safety switch.

The luminaire shown in FIG. 1 comprises an elongate housing 1, which is a trough with a generally U-shaped cross-section. A wall 1*a* of the housing is made from pre-lacquered steel or aluminium strip material which is approximately 0.2 mm thick. The edges 2 and 3 situated near the open side are folded inwards. At its ends the housing has plastics fittings 4 and 5, respectively, (made, for example, of polycarbonate) to accommodate a tubular low-pressure mercury vapour discharge lamp (not shown). These fittings may be separate components which are mounted by the user on the housing, whereafter they form, by means of electric and mechanical contacts, a connection to current supply wires in the housing. A prism-shaped ballast 6, consisting of a number of turns of insulated copper wire 7 around a laminated core 8, is situated within the housing. The ballast 6 and the housing 1 are of such a shape and dimension that the surface of the ballast bears against three sides of the housing (see also FIG. 2). Within the housing there is also a plastics holder 9 of a special shape. This holder consists of a plastics support, which includes components for the starter system, such as a capacitor and a safety switch, to protect a starter in the case of repeated starting (see FIG. 5). In one embodiment the starter itself may also be included in holder 9.

The holder 9 further comprises three current supply pins 9*a*, 9*b* and 9*c* (for live, neutral and ground, respectively) which are situated in a cavity 10 in the cured foamed plastics material 11, which extends to the open side between the folded edges 2 and 3 of the housing 1, and the end walls 4*a* and 5*a* of, for example, polycarbonate.

The above-mentioned components 6 and 9 in the housing as well as electric supply wires 12 and 13 (see FIG. 2) are wholly surrounded by the plastics material 11. The ballast 6 and the holder 9, as well as the fittings 4 and 5 have contact terminals by means of which they are electrically connected to the wires 12 and 13 (which are surrounded by a plastics insulation layer) embedded in the foam. Wires 12 and 13 are further insulated from the ballast by the foam. The ballast is held in position by means of its end faces 15 and 16 by the foam. A quantity of cured foamed plastics material, which acts as an electrical insulator for the ballast and as a protection for the electric wires from the heat which is generated by the ballast during operation, is also present between the open side (facing, for example, the ceiling) and that portion 17 of the ballast facing that side. The power supply wires 18 (see FIG. 3) is situated at, for example, that side of an elongate support 20 (see FIG. 3) which faces the housing, this elongate support to which the luminaire can be fastened in a detachable manner having been fastened to a ceiling 21. This side of the support is further provided with a terminal block (not shown), one end of which is connected to the above-mentioned power supply wires, the other side having been provided with socket members which co-operate electrically with current connecting pins 9*a*, 9*b* and 9*c*. When the housing is positioned on the support the said terminal block is accommodated in the cavity 10. The support itself can be connected to a wall or a ceiling 21 by means of screws. The housing is connected in a detachable manner to the support by means of a coupling which is shown in detail in FIG. 3.

The coupling shown in FIG. 3 comprises a sleeve 22, which is situated in an aperture in the wall of the housing, a plunger 23 whose length and diameter match the dimensions of the sleeve being present in this sleeve. The plunger 23 is provided with a recess 24 which co-operates with lugs 25 and 26 projecting from the plate-shaped support (such a coupling is described, inter alia, the aforementioned patent).

In a practical embodiment of the above-described luminaire according to the invention, the foamed plastics material consists of polyisocyanurate foam.

During manufacture, this foam is applied in the housing in the liquid state, after the required components (such as the ballast, the starter with their connecting wires, the components of the coupling 22, etc.) have been positioned in the housing. The liquid plastics material is injected in a measured quantity into the open side of the housing by means of a tubular injector, which moves along the full length of the housing. After a comparatively short period of time the liquid material expands and cures, a uniform cellular structure being obtained. The foam has then adhered to the wall of the housing and to the components (such as ballast 6, holder 9 and sleeve 22) located therein. The density of the said foam is comparatively low and its weight is comparatively low. At the open upper side of the housing the foam may be covered with a plastics film to improve the sealing of the luminaire. The foam adhering to the wall of the housing gives a comparatively high degree of rigidity to the housing. The cured polyisocyanurate foam has good electrical insulating properties, is flame-retardant and does not corrode the components and the connecting wires. The foam properly positions the several components and avoids exercising tensile forces on the connections between these components and the connecting wires. The foam hardly shrinks during curing. The housing of the above-described luminaire houses one ballast and one starter, that is to say the luminaire is suitable to accommodate one lamp. It is, however, possible to arrange a greater number of ballasts and starters in the housing. The luminaire is then suitable to accommodate a plurality of lamps. For example, for two lamps the housing is provided with four wires, two ballasts, etc. The fittings 4 and 5 are then of such a construction that they can accommodate two lamps. FIG. 4 shows schematically such a construction for two lamps. The length of the support 20 is relatively arbitrary. It may extend along the full length of the housing, but it is likewise possible for the support to be longer than the housing or to be only present near the centre and to extend over only a comparatively small portion of the length, for example over one-third part of the overall length of the housing. The said coupling is then, for example, provided in two positions, near the ends of the support. Additionally, the support may be provided with means for the connection of a reflector 27 (see FIG. 4).

FIG. 4 is a cross-sectional view of an embodiment of a luminaire according to the invention in which the foam if provided, at least partly, in the region of the open side of a recess 28 extending in the longitudinal direction to incorporate electric supply wires which may be enveloped by a pipe or tube (not shown). The above-mentioned plastics film is denoted by reference numeral 29.

FIG. 5 shows a longitudinal section of the portion of the housing where a safety switch for a starter has been provided. On repeated operation of the starter (for example when a lamp in the luminaire refuses to ignite), the temperature in the ballast may increase to an undesirably high value owing to the continuous passage of current. The foam in the region of the ballast may then become too hot. To prevent this unwanted phenomenon, the current is interrupted by the switch. The safety switch is situated in the plastics holder 9 which is free internally of foam and which is embedded in the plastics material 11. The switch is in the form of a bimetal contact which is connected in series with the starter 32 in the foam via wire 31, this contact being formed by a bimetal strip 33 and the current conductor 34 connected to wire 31. A heating element 35 (for example a resistor), which is connected in series with the bimetal strip 33 is situated near the bimetal strip 33. This element 35 is connected to the ballast (not shown) by means of a wire 36. If now the starter 32 tries repeatedly without success to ignite the lamp in the luminaire the switch is opened because the heat generated in element 35 bends the bimetal strip 33 to the position 33*a* (shown in the Figure by means of a broken line). Then no current flows through the wires of the electric circuit. In addition, the electrical circuit to the ballast is broken. The bimetal strip 33 is provided with a boss 33*b* which causes the bimetal strip to remain in position 33*a*, also after cooling. The bimetal strip can only be readjusted to its original condition ("switch closed") by displacement of the bimetal strip 33 by the application of pressure in the region of boss 33*b*. This is effected by means of a plunger 37 with a plastics arm 38. A user can press the plunger 37 with for example a narrow object through aperture 39 in the wall 1*a* (the safety switch can thus be actuated manually to allow it to be reset).

What is claimed is:

1. A luminaire for at least one tubular discharge lamp comprising an elongate thin walled housing with lamp accommodating means positioned at the ends of said housing, at least one electric stabilization ballast situated in the housing, the housing being filled with a quantity of cured foamed plastics material, characterized in that said housing is trough-shaped with generally U-shaped cross-section and the cured foamed plastics material extends to the open side of said housing and is cured within said luminaire.

2. A luminaire as claimed in claim 1, characterized in that the housing and the ballast are of such a shape and dimensions that the ballast bears against the three sides of the housing, foamed plastics material being present between an imaginary plane through the open side of the housing and the ballast.

3. A luminaire as claimed in claim 1 or claim 2, characterized in that the elongate wall edges of the housing are folded inwards at the open side.

4. A luminaire as claimed in claim 1, 2 or 3, characterized in that in the region of the open side the foamed plastics material is provided at least partly with a recess extending in the longitudinal direction of the housing.

5. A luminaire as claimed in claims 1 to 4, characterized in that the foamed plastics material includes a cavity at the open side, current connecting pins having been provided within the cavity.

6. A luminaire as claimed in any one of claims 1 to 5, characterized in that it comprises means for connecting it in a detachable manner to an elongate support.

7. A luminaire as claimed in any one of claims 1 to 6, characterized in that the foamed plastics material comprises polyisocyanurate foam.

8. A luminaire as claimed in any one of claims 1 to 7, characterized in that a starter is arranged in the housing in series with a safety switch to protect the starter in the case of repeated attempts to start, which switch is manually operable through an aperture provided in the wall of the housing.

* * * * *

UNITED STATES PATENT AND TRADEMARK OFFICE

CERTIFICATE OF CORRECTION

PATENT NO. : 4,419,719

DATED : December 6, 1983

INVENTOR(S) : KORNELIS BOER ET AL

It is certified that error appears in the above—identified patent and that said Letters Patent is hereby corrected as shown below:

In the drawing, add Fig. 4 and Fig. 5, per the attached sheet.

Signed and Sealed this

*Twentieth* Day of *August 1985*

[SEAL]

*Attest:*

DONALD J. QUIGG

*Attesting Officer* *Acting Commissioner of Patents and Trademarks*

2/2